United States Patent [19]

Krogsrud et al.

[11] Patent Number: 4,683,526

[45] Date of Patent: Jul. 28, 1987

[54] ASYMMETRIC LAMP

[75] Inventors: Jens C. Krogsrud, Oslo, Norway; Kai O. Sørensen, Lyngby, Denmark

[73] Assignee: Jac Jacobsen A/S, Norway

[21] Appl. No.: 931,945

[22] Filed: Nov. 19, 1986

Related U.S. Application Data

[63] Continuation of Ser. No. 795,638, Nov. 6, 1985, abandoned.

[51] Int. Cl.[4] ..... F21V 7/00

[52] U.S. Cl. ..... 362/346; 362/343; 362/341

[58] Field of Search ..... 362/346, 341, 343, 347, 362/348, 338, 285

[56] References Cited

U.S. PATENT DOCUMENTS

| | | | |
|---|---|---|---|
| 1,485,777 | 3/1924 | Hartmann | 362/343 |
| 1,485,853 | 3/1924 | Jones | 362/343 |
| 1,818,875 | 8/1931 | Wardwell | 362/285 |
| 2,380,447 | 7/1945 | Jungerson | 362/341 |
| 3,185,034 | 5/1965 | Youngblood, Jr. | 362/348 |
| 4,293,901 | 10/1981 | Hernandez | 362/346 |
| 4,298,921 | 11/1981 | Kroysand et al. | 362/346 |
| 4,428,030 | 1/1984 | Balozian | 362/346 |
| 4,514,793 | 4/1985 | Andreason | 362/342 |
| 4,517,631 | 5/1985 | Mullins | 362/346 |
| 4,528,618 | 7/1985 | Bitsch | 362/347 |

*Primary Examiner*—Raymond A. Nelli
*Attorney, Agent, or Firm*—Pasquale A. Razzano

[57] ABSTRACT

An asymmetric lamp with an improved reflector assembly is disclosed. The lamp includes a head, a socket for receiving a light bulb, and a front reflector. The socket and the front reflector are mounted in the head. When the light bulb is inserted into the socket, the light bulb defines a transverse axis. The front reflector has a longitudinal cross-sectional shape that is either generally hyperbolic, generally parabolic, or generally elliptic. The front reflector is formed from a plurality of triangular facets. Adjacent facets define a line that is nonparallel to the transverse axis defined by the light bulb. The front reflector is mounted in the head so that the rear edge of the front reflector is positioned proximate the top of the light bulb. The lamp may include a back reflector, preferably made from a nonconductive material. The back reflector is positioned proximate the rear edge of the front reflector. The back reflector may have rounded upper and lower portions, which conform to the rounded top and bottom sections of the light bulb. The lower portion of the back reflector may extend forward of the bottom of the light bulb, and a notch may be formed in the lower portion of the back reflector. One or more louver strips may be located at the front edge of the front reflector.

20 Claims, 8 Drawing Figures

FIG. 1
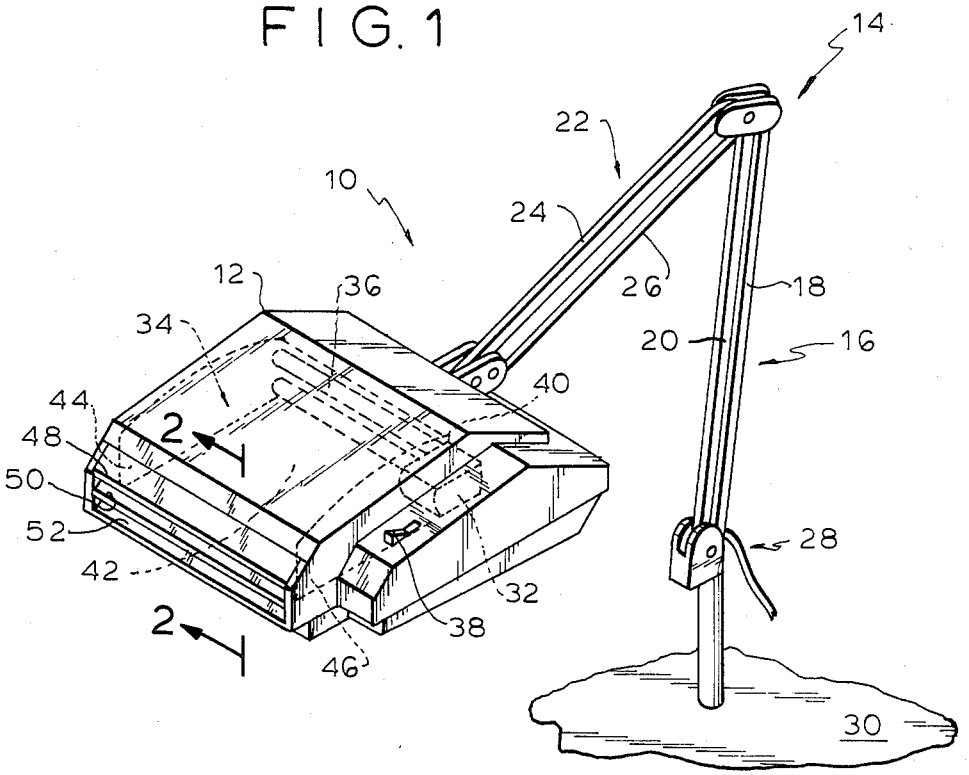
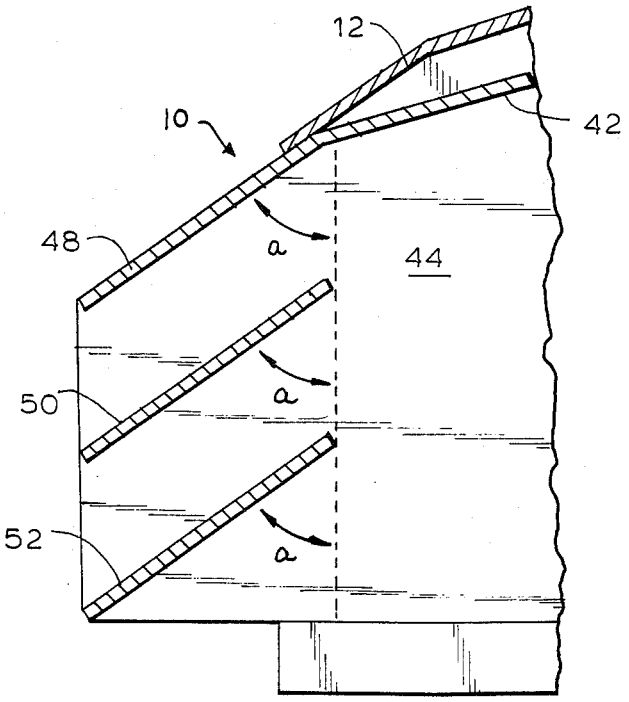
FIG. 2

ASYMMETRIC LAMP

This application is a continuation of application Ser. No. 795,638 filed Nov. 6, 1985, now abandoned.

BACKGROUND OF THE INVENTION

The present invention relates, in general, to lighting devices. More particularly, the present invention pertains to an asymmetric lamp, having an improved reflector assembly, that provides a better quality of light for a user.

Generally, asymmetric lamps, such as desk lamps or table lamps, which are designed to provide illumination for a work area should:

(a) uniformly illuminate the work area, such as an area approximately 11 inches wide by approximately 17 inches long;
(b) gradually reduce the light level from the work area to surrounding areas, including areas toward, under, and behind the lamp;
(c) be operable from a position away from the work area to leave the illuminated work area clear and the user's movements unrestricted;
(d) project light at a suitable angle onto the work area;
(e) emit light below normal eye level, which, on the average, is about 40 centimeters above the plane of the work area;
(f) prevent glare; and
(g) be aesthetically pleasing in appearance.

However, designing a lamp that can satisfy the above criteria and be economically produced is difficult. In practice, many design trade-offs must be made in order to manufacture an acceptable product.

Lamps that provide even lighting for a work area are known. For instance, U.S. Pat. No. 4,298,921 to Krogsrud et al. describes such a lamp. The lamp disclosed in this patent includes a reflector assembly with a plurality of facets.

Asymmetric lamps with curved reflectors have been suggested. For example, an asymmetric lamp having a hyperbolic reflector has been proposed. However, manufacturing a reflector that follows a smooth hyperbolic curve is difficult. Such a hyperbolic reflector is hard to fabricate economically inasmuch as tight tolerances must be maintained. Moreover, such a hyperbolic reflector typically includes surface irregularities, e.g., indentations and protrusions. These surface irregularities cause the light from the hyperbolic reflector to be nonuniform. That is, these surface irregularities produce discontinuities or striations in the light. The discontinuities in the light may be annoying to a user, especially if the lamp is vibrating, for instance, due to the operation of a typewriter or a printer. In an attempt to overcome the problem with discontinuities and striations, a generally hyperbolic reflector formed from a number of rectangular surfaces or facets has been produced. A Luxo PL-410 lamp made by Jac. Jacobsen A.S includes such a reflector. Although such a reflector has reduced the magnitude of the problem, such a reflector has not eliminated the problem.

Accordingly, a need exists for an inexpensive asymmetric lamp having a reflector assembly that provides uniform light without discontinuities and striations, and otherwise satisfies the criteria listed previously.

SUMMARY OF THE INVENTION

The present invention satisfies the needs specified above. The present invention overcomes the disadvantages associated with conventional lamps by providing an asymmetric lamp with an improved reflector assembly that projects light without disturbing striations or discontinuities.

A lamp according to one embodiment of the present invention includes a head, a socket for receiving a light bulb or source, and a front or top reflector. The socket and the front reflector are mounted in the head. When the light bulb is inserted into the socket, the light bulb defines a transverse axis. The front reflector has a longitudinal cross-sectional shape that is either generally hyperbolic, generally parabolic, or generally elliptic. The front reflector is formed from a plurality of triangular facets. Adjacent facets define a line that is nonparallel to the transverse axis defined by the light bulb. The front reflector is mounted in the head so that the rear edge of the front reflector is positioned proximate the top of the light bulb.

The front reflector may be mounted in the head so that its rear edge is located either forward of, rearward of, or approximately above the top of the light bulb when the light bulb is inserted into the socket. One or more louver strips may be positioned proximate the front edge of the front reflector. If more than one louver strip is used, the louver strips are arranged in a column. Preferably, the louver strips have a predetermined angle with respect to a vertical plane when the lamp is in a normal operating position. Predetermined angles between about 30 degrees and about 70 degrees are advantageous, with an angle of approximately 56.3 degrees being especially desirable. The louver strip or strips may be nonreflective in order to reduce glare.

The lamp may further include a back or rear reflector, preferably made from a nonconductive material, that is mounted in the head and positioned proximate the rear edge of the front reflector. The back reflector may have an upper portion that extends forward of the top of the light bulb. Furthermore, the back reflector may have a lower portion that extends forward of the bottom of the light bulb. The part that extends beyond the bottom of the light bulb reduces the amount of light that is emitted directly below and behind the light bulb, and more light is projected forwardly and onto the work area. The lower portion of the back reflector may include a notch in order to enable the light level to gradually decrease from the work area toward and past the lamp. A generally V-shaped notch with a vertex that is located forward of the bottom of the light bulb is desirable. The lamp may additionally include side reflectors that are mounted in the head and positioned proximate the side edges of the front reflector. The side reflectors increase the light level in the work area.

A lamp according to another embodiment of the present invention includes a head, a socket for receiving a light bulb with a rounded top section and a rounded bottom section, a front reflector, and a back reflector. The socket, the front reflector, and the back reflector are all mounted in the head. The back reflector is spaced from the light bulb when the light bulb is inserted into the socket. The back reflector has a rounded lower portion that conforms to the rounded bottom section of the light bulb. The lower portion of the back reflector extends forward of the bottom of the light bulb.

The lower portion of the back reflector preferably has a notch. A generally V-shaped notch with a vertex that is located forward of the bottom of the light bulb is desirable. Preferably, the back reflector is nonconductive and spaced from about 1 millimeter to about 3 millimeters from the light bulb. Additionally, the upper portion of the back reflector may be rounded to conform to the rounded top section of the light bulb, and the upper portion of the back reflector may extend forward of the top of the light bulb. Furthermore, the front reflector may have a generally hyperbolic longitudinal cross-sectional shape and may be formed from a number of facets, e.g., triangular facets.

The socket for the lamp advantageously receives a light bulb with a generally oval outline, such as a PL-type fluorescent lamp, which is available from Philips Industries, N.V. Accordingly, the back reflector may include a substantially planar portion between the upper portion and the lower portion.

Although two embodiments of a lamp according to the present invention are described in this section of the specification, these embodiments are not mutually exclusive. One lamp may include features from both embodiments.

BRIEF DESCRIPTION OF THE DRAWINGS

The above and other objects, features, and advantages of the present invention will become apparent upon consideration of the following detailed description of illustrative embodiments thereof, especially when taken in conjunction with the accompanying drawings, wherein:

FIG. 1 is a perspective view of a lamp according to the present invention;

FIG. 2 is an enlarged, fragmentary cross-sectional view of a lamp according to the present invention taken along line 2—2 of FIG. 1;

DETAILED DESCRIPTION OF THE PREFERRED EMBODIMENTS

Figure 4:
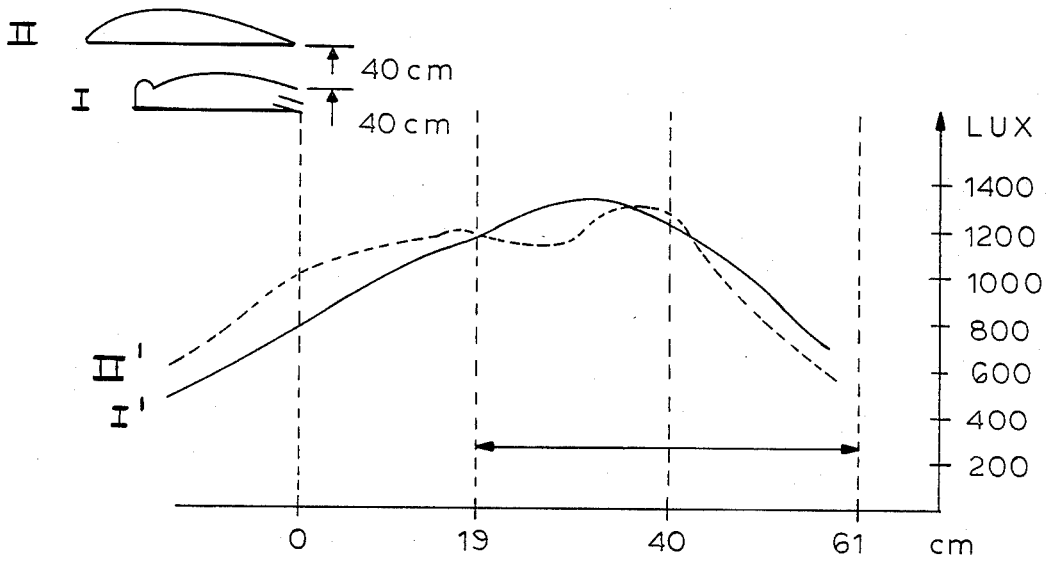
FIG. 4 is a graph with illumination at a work surface (in lux) plotted as a function of distance from a lamp (in centimeters) for each of two lamps according to the present invention.

Referring now to the drawings, and specifically to FIGS. 1 and 2, a lamp 10 according to the invention is shown. Lamp 10 has a lamp head or shade 12 that is supported on an arm assembly 14. Arm assembly 14 includes a lower arm unit 16, with arms 18 and 20, and an upper arm unit 22, with arms 24 and 26. Arm assembly 14 is mounted by a bracket 28 to a support 30, such as a table or a desk. Lower arm unit 16 pivots with respect to bracket 28, upper arm unit 22 pivots with respect to lower arm unit 16, and lamp head 12 pivots with respect to upper arm unit 22. Accordingly, lamp head 12 may be moved through a wide variety of positions. Lamp head 12 is substantially parallel to the surface of support 30 in a normal operating position of lamp 10.

A light socket 32 and a reflector assembly 34 are mounted in head 12. A light bulb or source 36 is inserted into socket 32. (As used in the specification and the claims, the term "light bulb" includes incandescent bulbs and lamps as well as fluorescent bulbs and lamps.) A PL-type fluorescent lamp is depicted as light bulb 36, although other types of lamps or bulbs may be employed. PL-type fluorescent lamps are available from Philips Industries N.V. A PL-type fluorescent lamp has a generally oval outline in cross section since it is formed from two tubes. A 24-watt PL-type fluorescent lamp is advantageously used in a lamp according to the invention. A user operates an on/off switch 38 to turn light bulb 36 on or off.

Reflector assembly 34 includes a back or rear reflector 40, a front or top reflector 42 (which has a generally hyperbolic longitudinal cross-sectional shape), side reflectors 44 and 46, and louver strips 48, 50, and 52. FIG. 2 better illustrates the louver strips 48, 50, and 52, while FIG. 3 better illustrates the components of reflector assembly 34, except for side reflectors 44 and 46, which are not shown.

FIG. 2 shows that lower louver strip 52 is located below middle louver strip 50 and that middle louver strip 50 is located below upper louver strip 48. In other words, louver strips 48, 50, and 52 form a column of louver strips. The louver strips are utilized so that the length of the front reflector may be shortened.

A short front reflector is desirable since a short front reflector permits a lamp head with a smaller total size to be used. A lamp head with a smaller total size may be positioned closer to the work area, thereby placing the light bulb closer to the work area and increasing the light intensity, without obstructing the user's movements. Moreover, a smaller lamp head is more aesthetically pleasing.

Three louver strips are shown, but no louver strips are required. However, when louver strips are used, the front reflector is truncated short of its design length. The louver strip or strips are then positioned at the front edge of the front reflector to shield the user's eyes from glare, which could cause discomfort to the user. The louver strip or strips may be nonreflective, finished in black for instance, in order to further reduce glare.

Upper louver strip 48, middle louver strip 50, and lower louver strip 52 each have a predetermined angle a with respect to a vertical plane when lamp 10 is in a normal operating position. Preferably, the predetermined angle a is between about 30 degrees and about 70 degrees, and a predetermined angle of approximately 56.3 degrees is especially advantageous.

Figure 3:
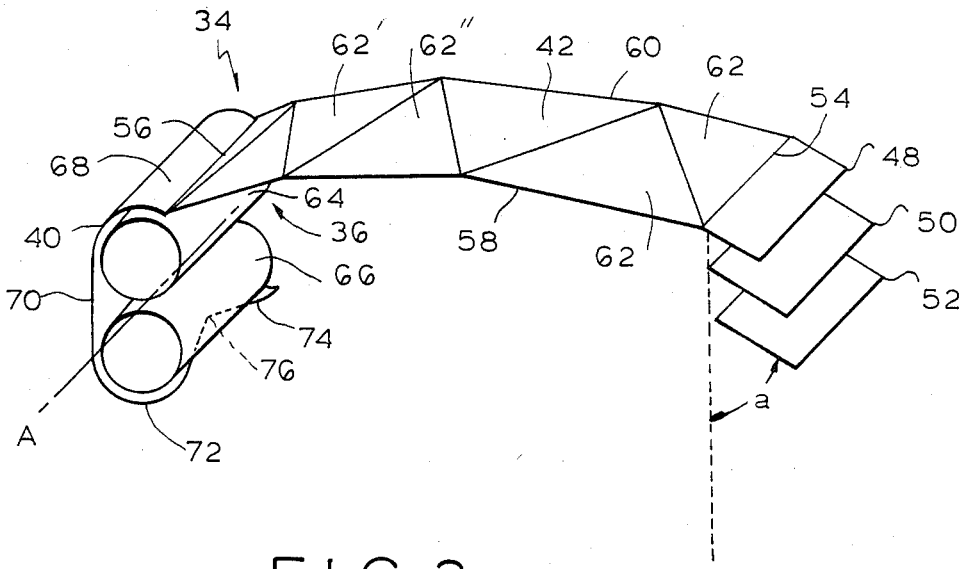
FIG. 3 is a diagrammatic illustration of a reflector assembly for a lamp according to the present invention.

FIG. 3 illustrates the components of reflector assembly 34 in more detail. Front reflector 42 has four edges: a front edge 54, a rear edge 56, a side edge 58, and another side edge 60. Back reflector 40 abuts rear edge 56 of front reflector 42. The column of louver strips 48, 50, and 52 is positioned at front edge 54 of front reflector 42, with louver strip 48 abutting front edge 54. Side reflector 44 (not shown) and side reflector 46 (not shown) are located along side edge 58 and side edge 60, respectively.

Front reflector 42 has a generally hyperbolic longitudinal cross-sectional shape, but other shapes may be used. For example, a front reflector with a generally parabolic or a generally elliptic longitudinal cross-sectional shape may also be used. Front reflector 42 is formed from a plurality of triangular surfaces or facets 62. Light bulb 36 defines a transverse axis A, which is parallel to the longitudinal axes of the tubes 64 and 66 that form light bulb 36. Tubes 64 and 66 schematically represent the two tubes that form a PL-type fluorescent lamp. Adjacent facets 62 define bend or fold lines that are nonparallel to axis A. For instance, a line is defined where facets 62' and 62'' meet. This line is not parallel to axis A.

The triangular facets 62 cause the light that is reflected by front reflector 42 toward the work area to be more even. That is, the triangular facets 62 reflect light in diagonally overlapping beams so that discontinuities and striations are eliminated. Thus, a better quality of light, i.e., light having a more uniform intensity and fewer discontinuities, is projected onto the work area. The triangular facets also make the front reflector less sensitive to the positioning of the socket within the head and to the positioning of the light bulb within the socket.

Various sizes and shapes of triangular facets may be employed in a lamp according to the invention. As is explained in the following description, the size of the facets may depend upon the type of curve (parabolic, hyperbolic, or elliptic) selected for the front reflector. A front reflector with a larger number of triangular facets usually emits light with fewer discontinuities than a front reflector with a smaller number of triangular facets. But a front reflector with a larger number of triangular facets may be more expensive to fabricate than a front reflector with a smaller number of triangular facets.

Back reflector 40 has a rounded upper portion 68, a substantially planar portion 70, and a rounded lower portion 72. Upper portion 68 is rounded to conform to the rounded top section of tube 64, while lower portion 72 is rounded to conform to the rounded bottom section of tube 66. A generally V-shaped notch 74 is formed in lower portion 72. The vertex 76 of notch 74 is located forward of the bottom of tube 66. (As used in the specification and the claims, the terms "top of the light bulb" and "top of the tube" refer to the topmost part of the bulb or the tube that forms the bulb. Similarly, the terms "bottom of the light bulb" and "bottom of the tube" refer to the bottommost part of the bulb or the tube that forms the bulb. Therefore, the top of the tube 64 is the line down the center of its top section, and the bottom of the tube 66 is the line down the center of its bottom section.) In other words, the bottom of tube 66 is completely covered by back reflector 40 even though lower portion 72 of back reflector 40 includes notch 74; lower portion 72 of back reflector 40 is located between light bulb 36 and the surface of support 30.

Back reflector 40 is preferably spaced, at its closest point, from about 1 millimeter to about 3 millimeters from light bulb 36. A spacing of approximately 2 millimeters is desirable. If back reflector 42 touches light bulb 36, a cold spot on the bulb may develop. The cold spot may become discolored due to the condensation of mercury vapor in the bulb. As a result of such a cold spot, the light output from the lamp would be reduced. However, if the back reflector is properly spaced from the light bulb, the cold spot problem is prevented.

Back reflector 40 is preferably made from a nonconductive material since the electric discharge in a fluorescent lamp may produce a magnetic field that induces eddy currents in the back reflector. A nonconductive back reflector obviates the eddy current problem. But a spacing of approximately 2 millimeters usually obviates the eddy current problem, too, even if the back reflector is conductive. Additionally, for a PL-type fluorescent lamp, a spacing of approximately 2 millimeters permits a sufficient amount of air to circulate around the lamp so that the temperature of the lamp is maintained at about the temperature for maximum light output from the lamp.

Because back reflector 40 is close to and conforms to the light bulb, the back reflector reflects light through the light bulb to the front reflector. The front reflector then projects the light from the lamp. Consequently, the light output of the lamp is increased. Thus, the lamp may be located farther from the work area or a smaller light bulb, i.e., one using less energy, may be employed. In addition, since the lower portion of the back reflector extends forward of the bottom of the light bulb, the light that the light bulb emits straight down is reflected back into the light bulb, which increases its brightness and the intensity of the emitted light. However, the notch in the lower portion, which does not uncover the bottom of the light bulb, prevents a sharp, undesirable decrease in the light level below the lamp. The notch permits the light level to gradually decrease in the areas below and behind the lamp.

Side reflectors 44 and 46 increase the light level in the work area. Namely, the side reflectors may increase the light level by approximately 10 percent in parts of the work area that are nearer to the lamp. But the side reflectors produce only a minimal increase in the light level in parts of the work area that are farther from the lamp and in areas outside of the work area.

As indicated previously, the front reflector may have a generally parabolic, hyperbolic, or elliptic longitudinal cross-sectional shape. The equation using $r-\theta$ coordinates for a given point on a parabola is as follows:

$$r=(2\times f)/(1+\cos\theta) \qquad \text{Eq. (1)}$$

where:

f is the focal width, i.e., the distance from the focal point (which is at the bottom of the light bulb) to the nearest point on the parabola;

r is the distance from the focal point to the given point on the parabola; and $\theta$ is the angle between a line along the focal width f and a line along r.

A hyperbola and an ellipse each have an additional focal point. The additional focal point for a hyperbola is located above the curve of the reflector, while the additional focal point for an ellipse is located below the curve of the reflector, and may even be located on the plane of the work area. A parabola may be considered to have an additional focal point that is located at infinity in the direction of the parabolic axis. Accordingly, the generalized equation using $r-\theta$ coordinates for a given point on each of a parabola, a hyperbola, and an ellipse is as follows:

$$r=(2\times f\times f')/[(f+f')+(f'-f)\times\cos\theta] \qquad \text{Eq. (2)}$$

where:

f is the focal width, i.e., the distance from the first focal point (which is at the bottom of the light bulb) to the nearest point on the curve;

f' is the focal width for the additional focal point (positive for an ellipse, negative for a hyperbola, and infinite for a parabola);

r is the distance from the first focal point to the given point on the curve; and $\theta$ is the angle between a line along the focal width f and a line along r.

Preferably, the front reflector reflects light toward the work area at an angle of approximately 45 degrees to a vertical plane. Thus, in the section of the curve that is used as a reflector, a reflector with an elliptic shape is curved more, i.e., has a higher arc, than a reflector with a parabolic shape, and a reflector with a parabolic shape is curved more, i.e., has a higher arc, than a reflector with a hyperbolic shape. Consequently, an elliptic reflector focuses light onto a smaller area than a parabolic reflector, and a parabolic reflector focuses light onto a smaller area than a hyperbolic reflector. Therefore, the increase in the light level in the work area due to the reflector is sharpest for an elliptic reflector, less for a parabolic reflector, and still less for a hyperbolic reflector.

For a reflector formed with facets, the increase in the light level in the work area due to the reflector is less drastic than for a reflector that uniformly follows a curve. Coarser or wider facets cause the light level to increase more slowly. Thus, coarser facets may be used for an elliptic reflector, which produces the sharpest increase. But very coarse facets may be impractical for a hyperbolic reflector because the light level may increase too slowly.

A faceted parabolic reflector may, given certain design constraints, be more desirable than a faceted hyperbolic reflector or a faceted elliptic reflector. With a faceted parabolic reflector, the light level may satisfactorily increase even when comparatively coarse facets are employed. Moreover, a parabolic reflector has a lower arc, i.e., is not as high, as an elliptic reflector. Consequently, a parabolic reflector may be mounted within a smaller lamp head. However, faceted hyperbolic reflectors and faceted elliptic reflectors are also advantageous. A hyperbolic reflector may be employed in a lamp with a relatively low head inasmuch as a hyperbolic reflector has a lower arc than a comparable parabolic or elliptic reflector.

Equations 1 and 2 indicate that the focal width f may be changed to alter the angle of the light beam that is emitted by the reflector. The focal width f is the distance from the focal point to the nearest point on the curve. For design purposes, the focal point is selected to be at the bottom of the light bulb. However, a lamp according to the invention may be designed with a focal point located elsewhere. For a hyperbolic reflector and an elliptic reflector, the focal width f' may also be changed to alter the angle of the light beam that is emitted by the reflector.

As an example, a hyperbolic reflector with a focal width f of about 35 millimeters and a focal width f' of 1,275 millimeters is advantageously utilized with a 24-watt PL-type fluorescent lamp. The emitted light beam has an angle of approximately 45° with respect to a vertical plane (45° with respect to a horizontal plane).

Broadly speaking, the focal width f focuses the light beam, while the focal width f' diffuses the light beam. The focal width f may be decreased to vary the angle of the emitted light beam so that the lamp is more asymmetric, i.e., so that the lamp illuminates a more distant work area. As another example, the focal width f may be decreased to project the emitted light beam at an angle of approximately 50° with respect to a vertical plane (40° with respect to a horizontal plane) without significantly reducing the light level in the work area, which is farther from the lamp.

Figure 7:
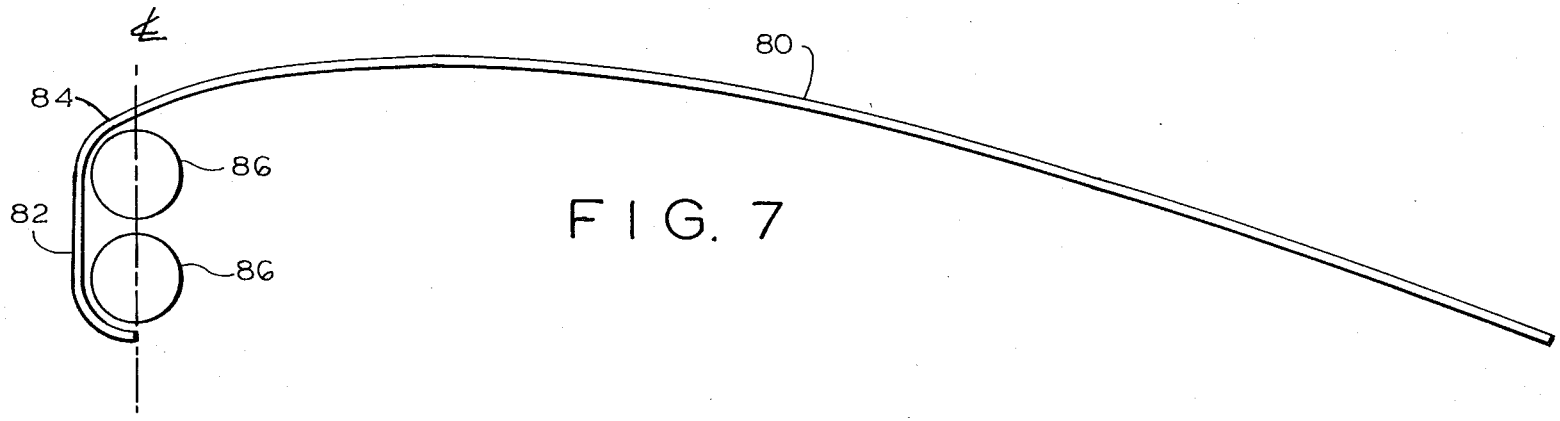
FIG. 7 is a diagrammatic illustration of a front reflector and a back reflector for a lamp according to the present invention.
Figure 8:
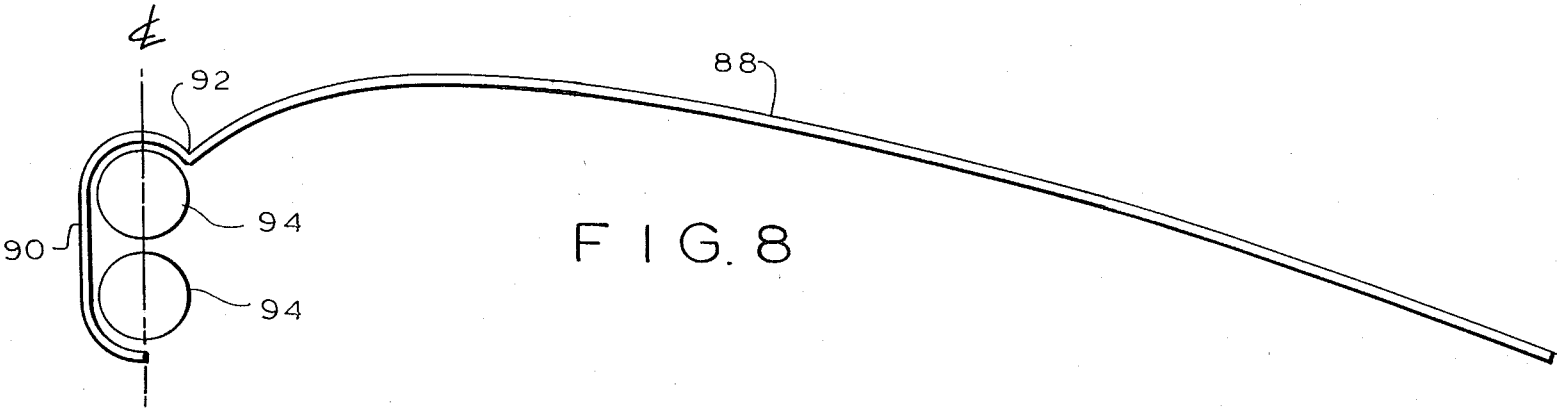
FIG. 8 is a diagrammatic illustration of another front reflector and another back reflector for a lamp according to the present invention.

FIGS. 7 and 8 schematically illustrate front and back reflectors. Each of the front reflectors has a generally hyperbolic shape. Furthermore, each of the front reflectors is faceted, but for the sake of convenience, the facets are not depicted. In FIG. 7, a front reflector 80 meets a back reflector 82 at a point 84 that is rearward of the top of the light bulb 86, while in FIG. 8, a front reflector 88 meets a back reflector 90 at a point 92 that is forward of the top of the light bulb 94. Because the front reflector 88 joins the back reflector 90 forward of the top of the light bulb, a lamp having the configuration shown in FIG. 8 has a slightly lower efficiency than a lamp having the configuration shown in FIG. 7. However, the FIG. 8 configuration enables the focal width f to be reduced, and light may be projected farther into the work area.

Figure 5:
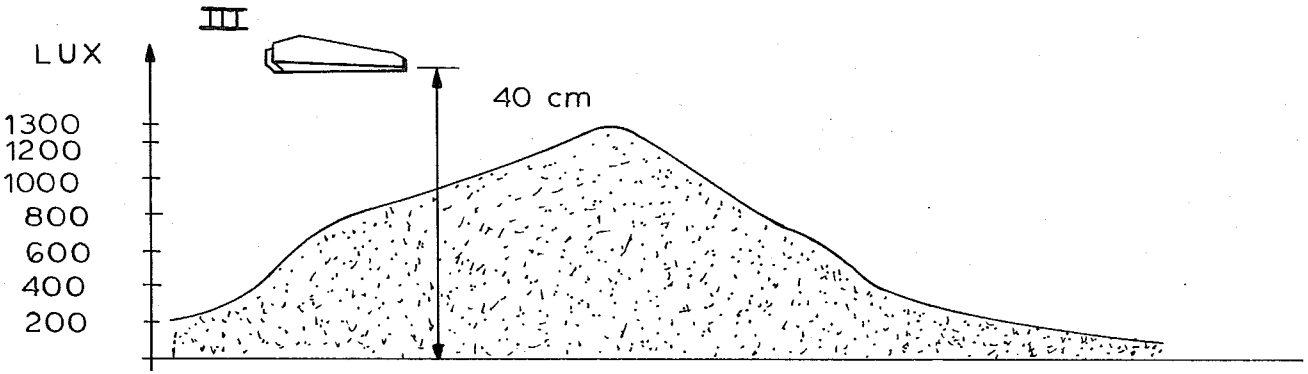
FIG. 5 is another graph with illumination (in lux) plotted as a function of distance (in centimeters) for another lamp according to the present invention.
Figure 6:
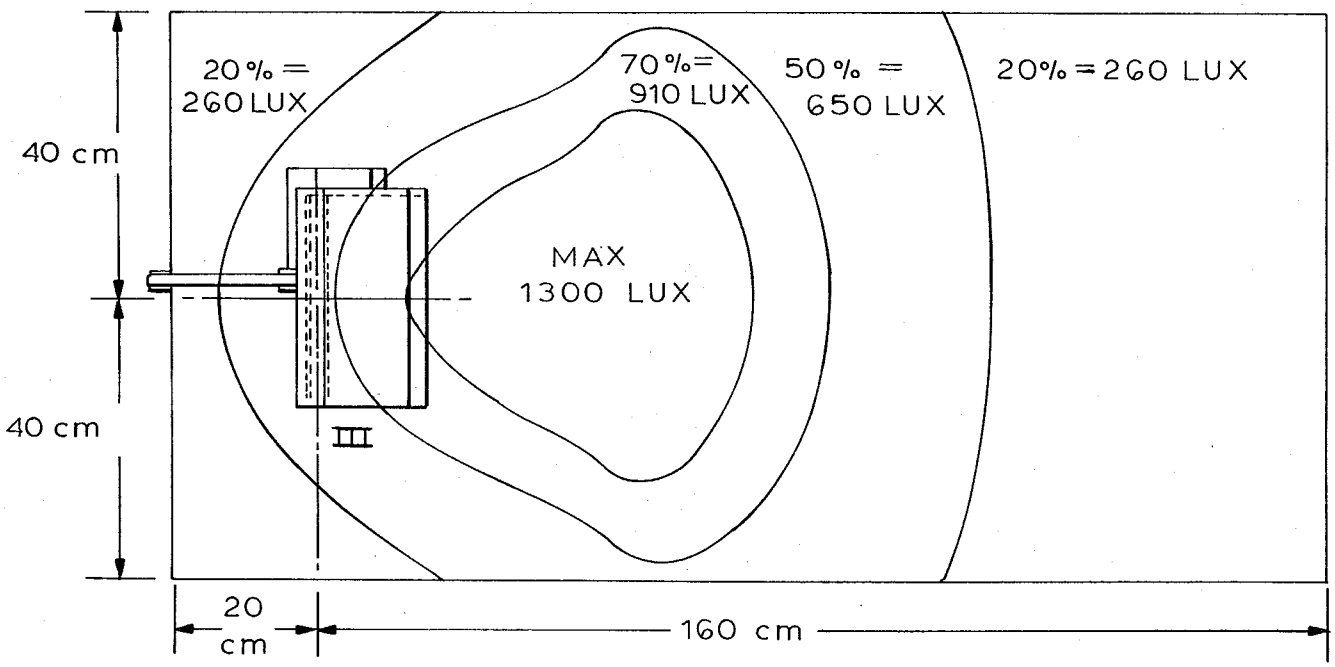
FIG. 6 is a chart showing lines of constant illumination for the lamp used to provide the data for the graph of FIG. 5.

FIGS. 4, 5, and 6 depict light levels, in lux, for various lamps according to the invention. Each lamp has a generally hyperbolic front reflector with a plurality of triangular facets. A 24-watt PL-type fluorescent lamp was used in each of the lamps.

FIG. 4 shows light levels as a function of distance from each of two lamps, which are designated by the Roman numerals I and II. Each of the lamps I and II has a generally hyperbolic front reflector with triangular facets, as noted before. For ease of illustration, the triangular facets are not depicted. The lamp I has a back reflector at the rear edge of the front reflector and louver strips at the front edge of the front reflector. Additionally, the back reflector meets the front reflector at a point forward of the top of the light bulb, in an arrangement similar to the one shown in FIG. 8. Each of the lamps I and II is located approximately 40 centimeters above the plane of the work area. The curves I' and II' correspond to the lamps I and II, respectively. The work area is from about 19 centimeters to about 61 centimeters from the lamp and is centered approximately at 40 centimeters from the lamp. The curves I' and II' show that the lamps I and II uniformly illuminate the work area and that the light intensity gradually declines away from the work area. The lamp I, however, projects light farther into the work area.

FIGS. 5 and 6 illustrate the same advantages of a lamp according to the invention. The lamp III is positioned approximately 40 centimeters above the plane of the work area. The lamp III projects a light beam forwardly, at an angle, onto the work area.

Although particular illustrative embodiments of the present invention have been described herein with reference to the accompanying drawings, the present invention is not limited to these particular embodiments. For example, although a counterbalanced lamp head is illustrated and described in the drawings, the lamp head can be used in other ways. More specifically, the head can be used on a fixed mounting or as a so called "wall wash" to illuminate wall surfaces rather than work areas. Thus, the term "lamp" as used herein and in the appended claims is intended to encompass a light fixture having any desired mounting and illumination purpose. Further, various changes and modifications may be made thereto by those skilled in the art without departing from the spirit or scope of the invention, which is defined by the appended claims.

We claim:

1. A lamp, comprising:

a head, a faceted top reflector; a rear reflector; and a socket means for receiving a light source, the socket means being rearwardly mounted in the head, said light source defining a vertical plane generally parallel to said rear reflector, said light source also defining a horizontal line in said plane, said rear reflector being located generally rearward of said light source, said top reflector being located generally above said light source;

said faceted top reflector having a generally parabolic longitudinal cross-sectional shape, said top reflector including a plurality of triangular facets, adjacent facets defining lines that are nonparallel to said horizontal line defined by the light source, said top reflector having a front edge, a rear edge, and first and second side edges;

said rear reflector having an upper portion and a lower portion, said upper portion being located rearward of said rear edge of said top reflector, said lower portion generally conforming to the contours of said light source and extending forward of said vertical plane, said lower portion including a notch.

2. A lamp as defined in claim 1, wherein the rear edge of the top reflector is located forward of the top of the light source when the light source is inserted into the socket means.

3. A lamp as defined in claim 1, wherein the rear edge of the top reflector is located rearward of the top of the light source when the light source is inserted into the socket means.

4. A lamp as defined in claim 1, wherein the rear edge of the top reflector is located approximately above the top of the light source when the light source is inserted into the socket means.

5. A lamp as defined in claim 1, further comprising a first side reflector and a second side reflector, the first side reflector being mounted in the housing and located along the first side edge of the top reflector, the second side reflector being mounted in the housing and located along the second side edge of the top reflector.

6. A lamp as defined in claim 1, wherein the rear reflector is generally spaced from about 1 millimeter to about 3 millimeters from the light source, when the light source is inserted into the socket means.

7. A lamp as defined in claim 1, wherein the upper portion of the rear reflector is rounded to conform to the rounded top section of the light source when the light source is inserted into the socket means.

8. A lamp as defined in claim 1, wherein the socket means includes means for receiving a light source with a generally oval outline, and wherein the rear reflector includes a substantially planar portion between the upper portion and the lower portion.

9. A lamp as defined in claim 1, wherein the rear reflector has an upper portion that extends forward of said vertical plane.

10. A lamp as defined in claim 1, wherein the notch is generally V shaped with a vertex that is located forward of said vertical plane.

11. A lamp as defined in claim 1, wherein the rear reflector is nonconductive.

12. A lamp as defined in claim 1, further comprising a first louver strip, the first louver strip being mounted in the head and positioned proximate the front edge of the top reflector.

13. A lamp as defined in claim 12, wherein the first louver strip is nonreflective.

14. A lamp as defined in claim 12, further comprising a second louver strip and a third louver strip, the second and third louver strips being mounted in the head, the second louver strip being located below and spaced from the first louver strip, the third louver strip being located below and spaced from the second louver strip.

15. A lamp as defined in claim 14, wherein the first, second, and third louver strips have a predetermined angle with respect to a vertical plane when the lamp is in a normal operating position.

16. A lamp as defined in claim 15, wherein the predetermined angle is between about 30 degrees and about 70 degrees.

17. A lamp as defined in claim 16, wherein the predetermined angle is approximately 56.3 degrees.

18. A lamp as defined in claim 6, wherein the rear reflector is spaced approximately 2 millimeters from the light source when the light source is inserted into the socket means.

19. A lamp as defined in claim 7, wherein the upper portion extends forward of the top of the light source when the light source is inserted into the socket means.

20. A lamp as defined in claim 8, wherein the socket receives a PL-type fluorescent lamp.

* * * * *